United States Patent [19]

Kern

[11] Patent Number: 4,990,066

[45] Date of Patent: Feb. 5, 1991

[54] METERING PUMP

[76] Inventor: Hans Kern, Wimpasing 4, D-8221 Vachendorf, Fed. Rep. of Germany

[21] Appl. No.: 393,527

[22] Filed: Aug. 11, 1989

[30] Foreign Application Priority Data

Aug. 12, 1988 [DE] Fed. Rep. of Germany ..... 3827489

[51] Int. Cl.[5] ..... F04B 23/06

[52] U.S. Cl. ..... 417/307; 417/413

[58] Field of Search ..... 417/307, 311, 434, 435, 417/413, 283

[56] References Cited

U.S. PATENT DOCUMENTS 4,453,931 6/1984 Pastrone ..... 417/510

4,599,052 7/1986 Langden et al. ..... 417/413

4,776,771 10/1988 Kern ..... 417/307

FOREIGN PATENT DOCUMENTS 3631984 12/1987 Fed. Rep. of Germany .

*Primary Examiner*—Michael Koczo

*Assistant Examiner*—Robert N. Blackmon

*Attorney, Agent, or Firm*—Donald Brown

[57] ABSTRACT

A self-aspirating and self-venting metering pump comprises a pump chamber with a diaphragm valve for delivery to a metering point. In order to achieve a precise adjustment of the metering volume the diaphragm valve and the venting means are coupled to each other such that the venting means is open during a pressure stroke and closed during the suction stroke.

4 Claims, 4 Drawing Sheets

METERING PUMP

BACKGROUND OF THE INVENTION

The invention relates to a metering pump and in particular to a metering pump comprising a pump chamber with a diaphragm pump for delivery to a metering point and for the comprising of venting means in a return conduit connected to the outlet of the metering pump.

Such a metering pump is known from the German Patent No. 36 31 984. In this known metering pump the venting means is closed shortly before the beginning of the pressure stroke and opened shortly after the end of the metering stroke. A pressure valve is provided in the return conduit. As a consequence, the return flow is not exactly defined.

OBJECTS OF THE INVENTION

It is an object of the invention to provide an improved metering pump in which the above drawback is avoided.

It is a further object to provide a metering pump in which the return flow is exactly defined.

SUMMARY OF THE INVENTION

In order to achieve the above-mentioned objects the invention provides a metering pump comprising a pump chamber including a diaphragm pump and an outlet for connection with a metering point, a suction conduit for connection of the pump chamber with a metering agent tank, a suction valve in the suction conduit, a return conduit connected to the outlet and comprising a venting means and coupling means connecting the venting means to the diaphragm pump for opening the venting means during a pressure stroke of the diaphragm pump and closing the venting means during a suction stroke of the diaphragm pump.

BRIEF DESCRIPTION OF THE DRAWINGS

Further advantages, features and objects of the invention will stand out from the following description of exemplary embodiments with reference to the drawings, wherein.

DESCRIPTION OF PREFERRED EMBODIMENTS

Figure 1:
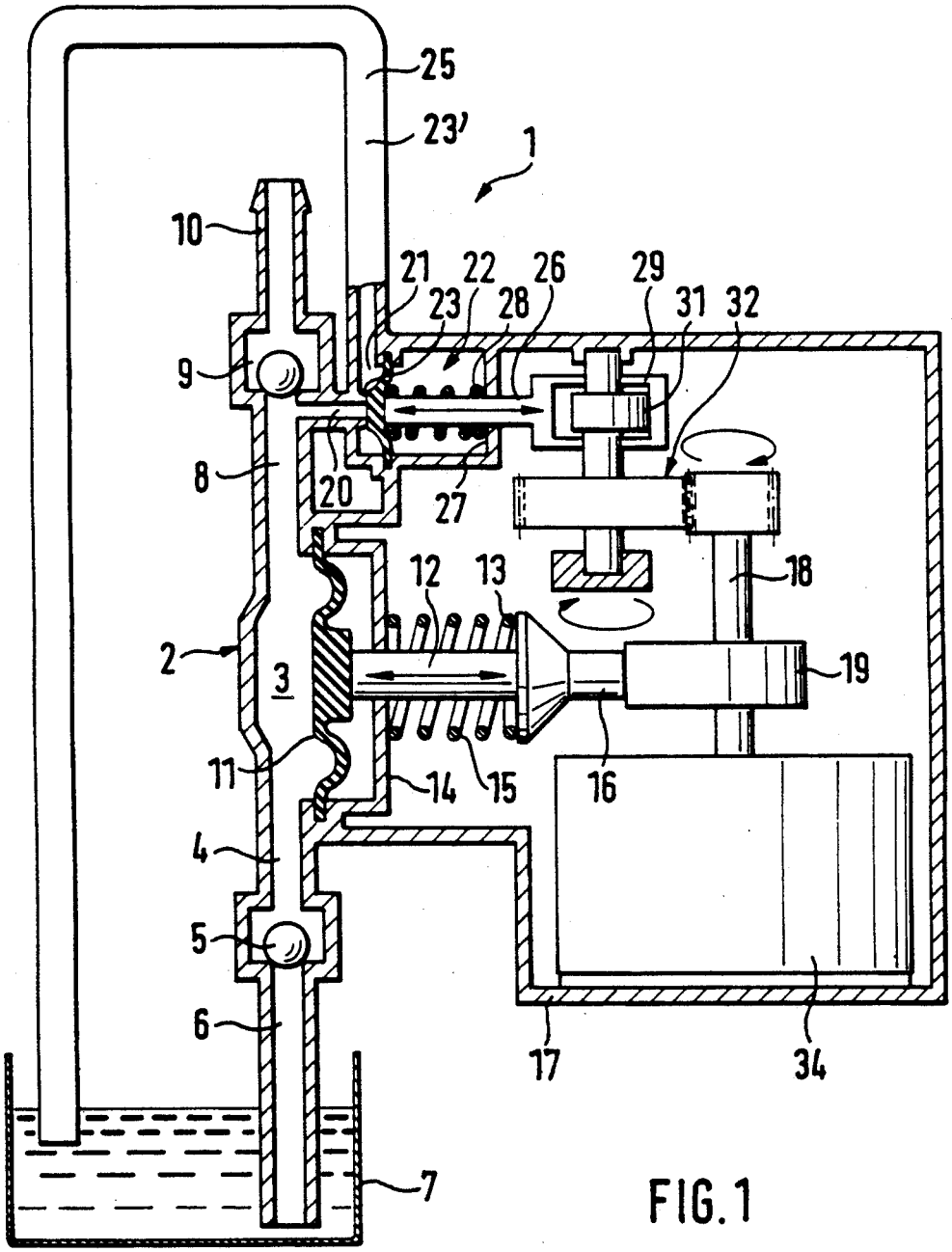
FIG. 1 is a sectional view of a first embodiment of a metering pump.

The metering pump 1 comprises a pump head 2 having a pump chamber 3 extending in vertical direction. From the vertically lower end of the pump chamber extends a suction channel 4 which is connected with a suction conduit 6 through a suction valve 5. The suction conduit 6 leads into a metering agent tank 7.

A riser conduit 8 leads into the pump chamber 3 at the vertically upper end thereof. The vertically upper end of the riser conduit leads through a pressure valve 9 to a connecting end 10 for connection with a metering point.

A diaphragm pump is provided within the pump chamber in the manner shown in FIG. 1. The diaphragm pump comprises a metering diaphragm 11 clamped at the edge thereof and being rigidly connected with a tappet 12 at its rear side. The tappet comprises a stop 13. A compression spring 15 prestressing the diaphragm 11 into the suction position is provided between the stop 13 and a fixed frame plate 14.

A motor 34 is mounted within the pump housing 17 which is connected to the pump head 2 in the manner shown in FIG. 1. The motor comprises a motor-driven shaft 18 which carries a metering cam 19. The end 16 of the tappet 12 is pressed into contact with the metering cam 19 by means of the compression spring 15.

A cross bore 20 extends from the rioser conduit 8 at the very upper end thereof, i.e. immediately upstream of or below the pressure valve 9, into the valve chamber 21 of a venting means which is formed by a diaphragm valve 22. A valve seat 23 is formed at the end of the cross bore 20. In the embodiment shown in this Figure a return conduit 25 leads from the vertically upper region of the valve chamber 21 back into the metering agent tank 7.

The diaphragm of the diaphragm valve 22 has the side thereof opposite to the valve chamber fixedly connected to a tappet 26. A compression spring 28 is provided between the rear side of the diaphragm and a wall portion 27 of the housing and the compression spring is prestressed such that the diaphragm is first held in the closing position shown in FIG. 1.

The end of the tappet opposite to the diaphragm comprises a yoke 29 engaging a second cam 31 mounted on the shaft 18. The cam 31 is connected with the shaft 18 through an intermediate gear 32.

The second cam 31 is designed such that the tappet 26 is moved in the desired angular region in such manner that the diaphragm of the diaphragm valve 22 performs a stroke against the action of the compression spring 28.

Figure 4A:
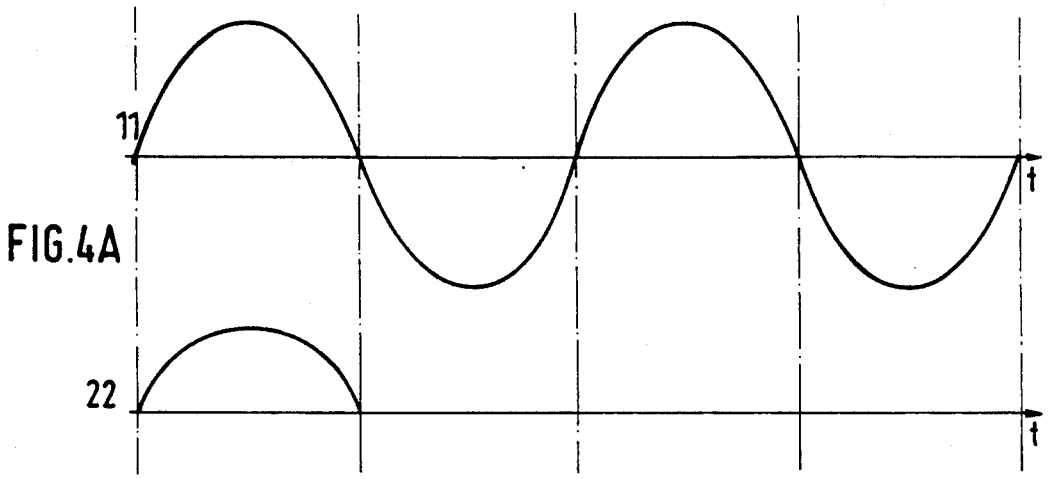
FIG. 4*a* to 4*c* is a graph showing the individual pump strokes as a function of time.

The two cams 19 and 31 are angularly offset from each other in such a manner that the sequence of strokes as shown in FIG. 4*a* occurs. It results therefrom that the diaphragm valve 22 is open during a metering stroke of the metering diaphragm 11. The venting valve formed by the diaphragm valve closes at the end of the metering stroke. It is ensured in this manner that any gas exits through the return conduit during the metering stroke.

A may be seen from FIG. 4*a* the gearing defined by the design of the intermediate gear 32 is selected such that the diaphragm valve 22 clears the return conduit not sat each metering stroke but at each n-th pressure stroke wherein n is a natural number smaller than the number of the metering strokes. The number n also determines the metered volume. In case of e.g. venting at every second stroke the original metered volume is divided by half. In case of venting at every tenth stroke the metered volume is reduced only by 1/10.

Figure 2:
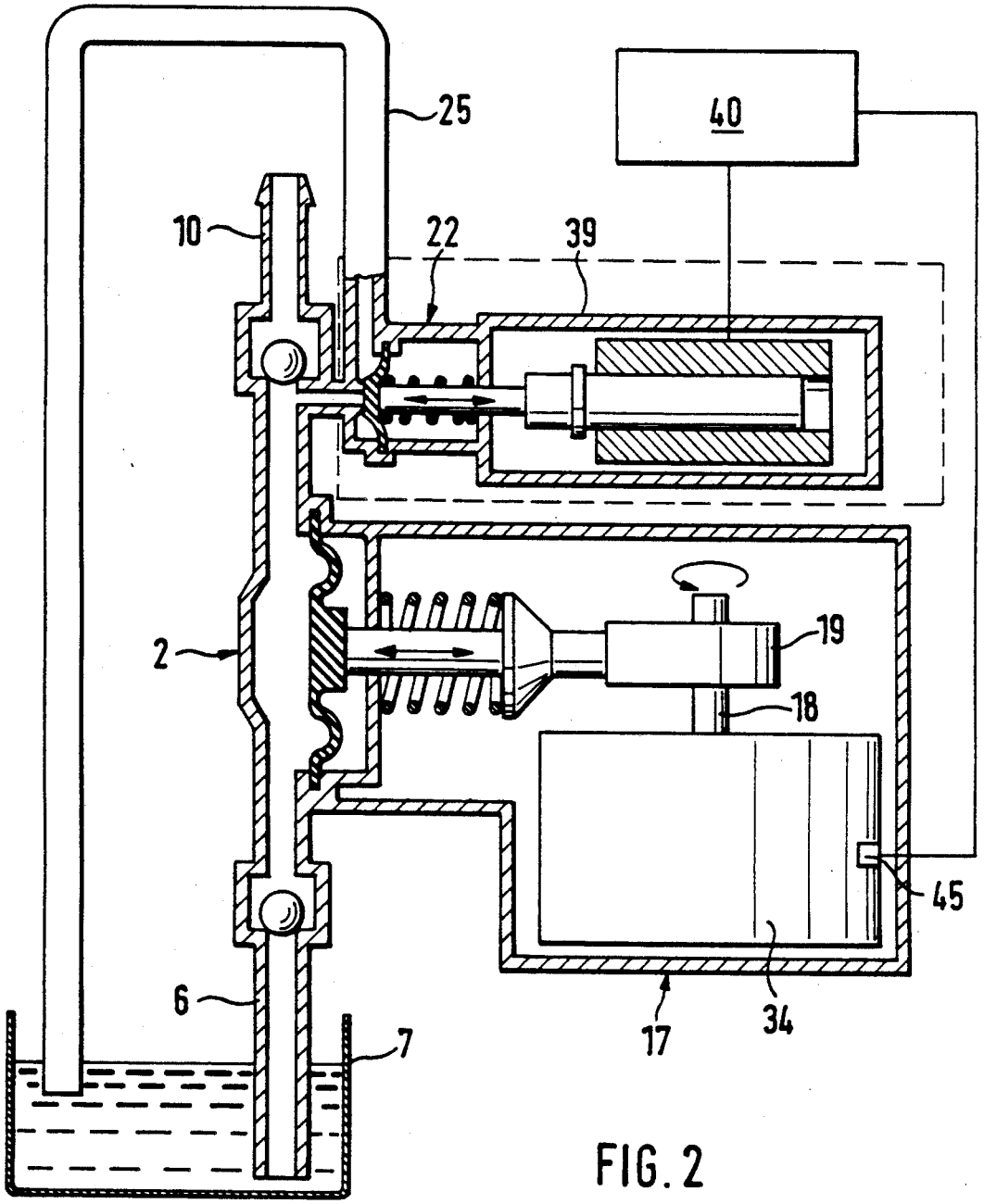
FIG. 2 shows a modified embodiment in a representation corresponding to that of FIG. 1.
Figure 4B:
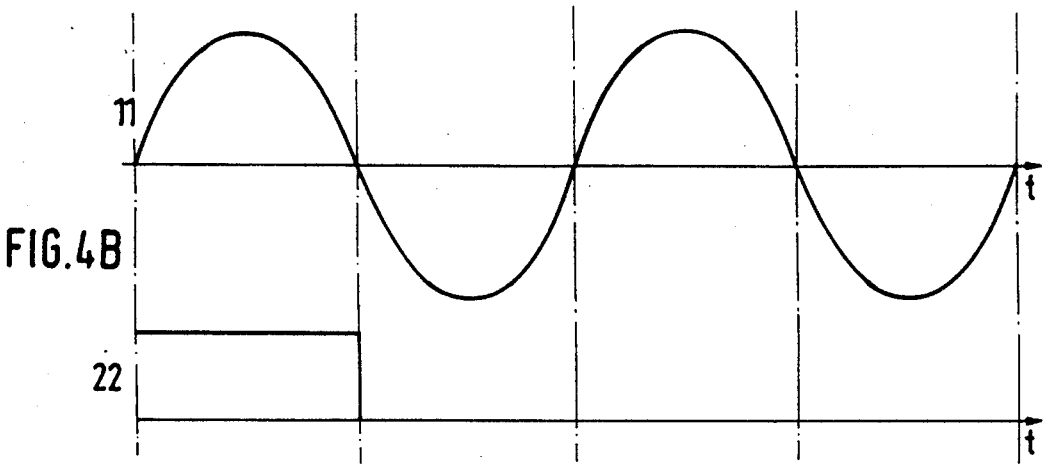

The embodiment shown in FIG. 2 differs from the one of FIG. 1 only in that the diaphragm valve 22 is actuated by a separate solenoid 39. The solenoid 39 is driven by a control unit 40. A sensor 45 is provided which detects the angular position of the metering cam 19 and provides an output signal responsive to this angular position to the control unit 40 in order to assure the synchronization of the metering stroke of the diaphragm valve 22 with the diaphragm 11 in the above-described manner. The control unit 40 is designed such that the venting is performed at every n-th metering stroke only as in the first embodiment, as may be seen from FIG. 4*b*.

Figure 3:
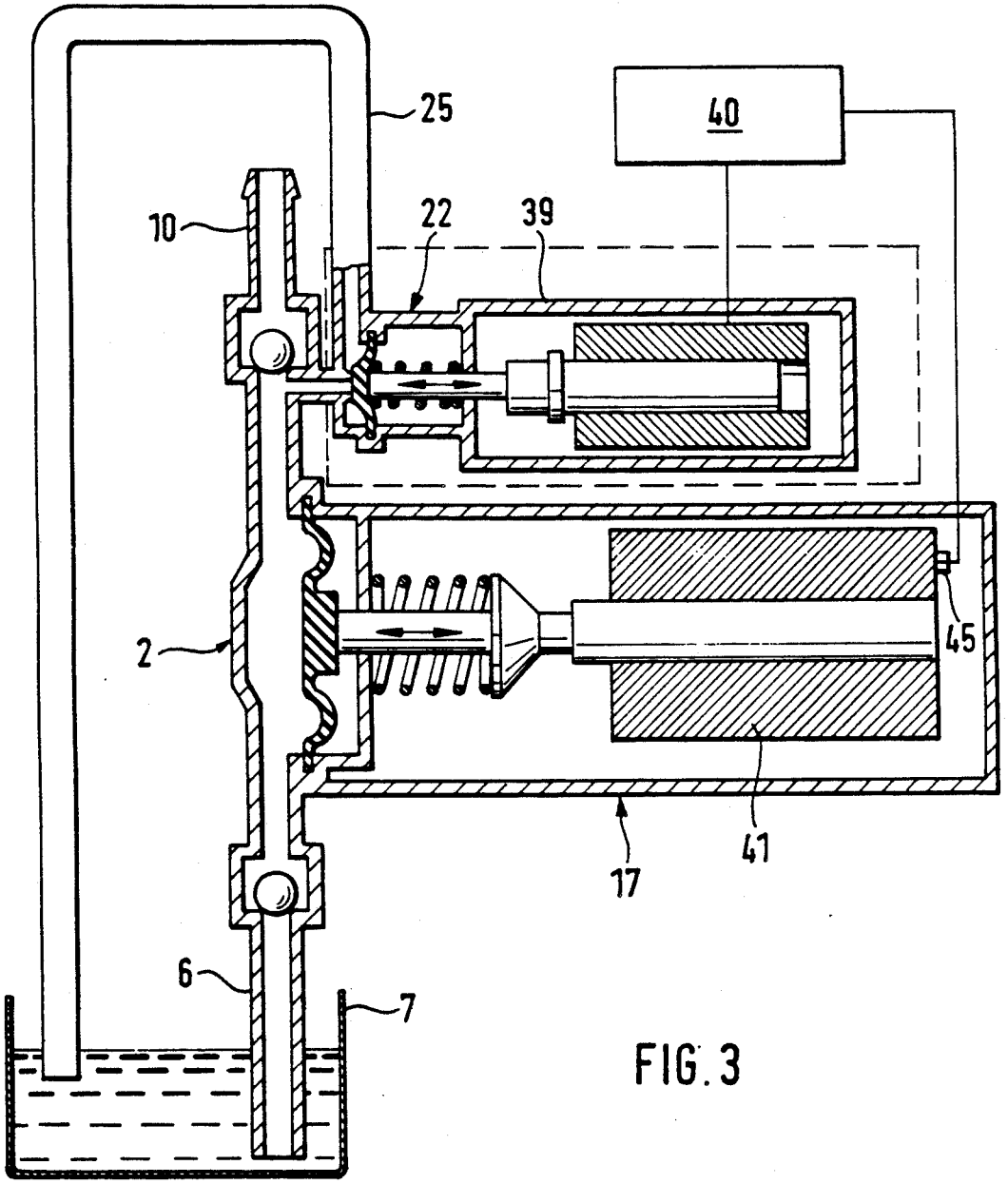
FIG. 3 shows a further modified embodiment in a representation according to FIG. 1.
Figure 4C:
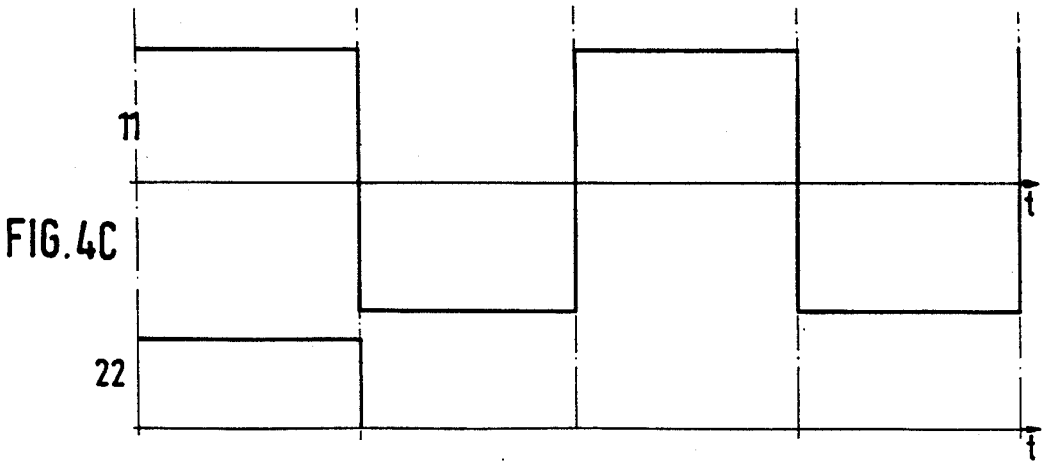

In the embodiment shown in FIG. 3 a second solenoid 41 is provided in place of the motor 34 with shaft 18 and metering cam 19. The two solenoids 39 and 41 are driven by the control unit 40. The operational sequence of the diaphragm 11 and the diaphragm of the diaphragm valve 22 is the same as in the preceding two embodiments, as may be seen from FIG. 4*c*. In all three embodiments the venting stroke is performed in synchronism with the respective metering stroke such that the venting valve is opened during each n-th metering stroke but otherwise closed. The number n can be selected on the control unit 40.

Although the invention has been described with reference to specific example embodiments, it is to be understood that it is intended to cover all modifications and equivalents within the scope of the appended claims.

What is claimed is:

1. A metering pump for pumping a fluid, comprising a pump chamber having an inlet and an outlet for connection with a metering point, a suction conduit connected with the inlet to the pump chamber such as to supply fluid via the suction conduit from a tank to the pump chamber, a suction valve in said suction conduit, a pressure valve at said outlet of the pump chamber, a return conduit branching off from said outlet immediately upstream of said pressure valve for connection of said outlet with said tank such as to return fluid from said pump chamber to the tank, a diaphragm in the pump chamber for inducing fluid from the tank into the pump chamber and through the outlet thereof to the metering point, first drive means for actuating the diaphragm to perform a suction stroke and a pressure stroke, venting means in said return conduit, second drive means for actuating said venting means to open or close said return conduit to allow or not allow fluid to pass through the return conduit from outlet to the tank, and means for controlling said second drive means in relation to said first drive means to cause said venting means to open said return conduit during a pressure stroke of the diaphragm and to close said return conduit during a suction stroke of said diaphragm.

2. The metering pump of claim 1, said control means being adapted to drive said venting means for opening said return conduit at each n-th pressure stroke only.

3. The metering pump of claim 1, said second drive means comprising a solenoid for actuating said venting means.

4. The metering pump of claim 1, said first drive means comprising a solenoid for actuating said diaphram.

* * * * *